US010576761B2

(12) United States Patent
Yabune

(10) Patent No.: US 10,576,761 B2
(45) Date of Patent: Mar. 3, 2020

(54) PRINTING APPARATUS CAPABLE OF PERFORMING PRINTING ON PARTIALLY-THICK SHEETS

(71) Applicant: RISO KAGAKU CORPORATION, Tokyo (JP)

(72) Inventor: Hirokazu Yabune, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 69 days.

(21) Appl. No.: 15/808,093

(22) Filed: Nov. 9, 2017

(65) Prior Publication Data

US 2018/0141354 A1 May 24, 2018

(30) Foreign Application Priority Data

Nov. 22, 2016 (JP) ..... 2016-226720

(51) Int. Cl.

| | |
|---|---|
| ***B65H 31/02*** | (2006.01) |
| ***B41J 13/00*** | (2006.01) |
| ***B41J 13/12*** | (2006.01) |
| ***B65H 43/08*** | (2006.01) |
| ***B41J 11/00*** | (2006.01) |
| ***B65H 43/06*** | (2006.01) |
| ***B41J 13/10*** | (2006.01) |
| ***B65H 29/00*** | (2006.01) |
| ***G03G 15/00*** | (2006.01) |

(52) U.S. Cl.

CPC ..... *B41J 13/0036* (2013.01); *B41J 11/0095* (2013.01); *B41J 13/106* (2013.01); *B41J 13/12* (2013.01); *B65H 29/001* (2013.01); *B65H 31/02* (2013.01); *B65H 43/06* (2013.01); *B65H 43/08* (2013.01); *G03G 15/6552* (2013.01); *B65H 2301/4212* (2013.01); *B65H 2405/115* (2013.01); *B65H 2405/1111* (2013.01); *B65H 2405/11151* (2013.01); *B65H 2511/11* (2013.01); *B65H 2511/13* (2013.01); *B65H 2511/16* (2013.01); *B65H 2511/30* (2013.01); *B65H 2511/414* (2013.01); *B65H 2701/1916* (2013.01); *B65H 2801/39* (2013.01); *G03G 2215/00911* (2013.01)

(58) Field of Classification Search

CPC .. B41J 13/0036; B41J 11/0095; B41J 13/106; B65H 29/001; B65H 31/02; B65H 31/08

See application file for complete search history.

(56) References Cited

U.S. PATENT DOCUMENTS

2014/0239577 A1* 8/2014 Kato ..... B65H 31/10 271/213

FOREIGN PATENT DOCUMENTS

| | | |
|---|---|---|
| JP | 2005-119848 | 5/2005 |
| JP | 2007-302360 | 11/2007 |
| JP | 2008-211691 | 9/2008 |

* cited by examiner

*Primary Examiner* — Thomas A Morrison

(74) *Attorney, Agent, or Firm* — Greenblum & Bernstein, P.L.C.

(57) ABSTRACT

A printing apparatus includes: a sheet discharge tray having an upstream portion tilted to extend downward in a direction of gravity; an upper member limiting a height of a space above the sheet discharge tray; a full sensor configured to detect an upstream end of a top sheet of sheets stacked on the sheet discharge tray; a counter configured to count a number of the sheets discharged onto the sheet discharge tray; and a controller. The controller determines whether to stop discharging of the sheets to the sheet discharge tray, based on a detection result of the full sensor upon the sheets to be stacked on the sheet discharge tray including only sheets each with uniform thickness and based on a count value of the counter upon the sheets to be stacked on the sheet discharge tray including a sheet with thickness varying partly.

4 Claims, 4 Drawing Sheets

PRINTING APPARATUS CAPABLE OF PERFORMING PRINTING ON PARTIALLY-THICK SHEETS

CROSS REFERENCE TO RELATED APPLICATION

This application is based upon and claims the benefit of priority from the prior Japanese Patent Application No. 2016-226720, filed on Nov. 22, 2016, the entire contents of which are incorporated herein by reference.

BACKGROUND

1. Technical Field

The disclosure relates to a printing apparatus capable of performing printing on partially-thick sheets such as envelopes.

2. Related Art

Japanese Patent Application Publication No. 2008-211691 describes a facsimile apparatus which can achieve downsizing and slimming down by arranging a sheet feed stacker, a sheet discharge stacker, and the like in an upper surface portion of an apparatus main body.

Japanese Patent Application Publication No. 2007-302360 describes an image formation apparatus including a scanner above a sheet discharger as an apparatus which can achieve downsizing and slimming down.

Japanese Patent Application Publication No. 2005-119848 describes a method for an image formation apparatus including a scanner above a sheet discharger to prevent a jam when sheets exceed a sheet discharge capacity.

SUMMARY

As described above, an image formation apparatus can be downsized and slimmed down by arranging a sheet discharger in an upper surface portion of an apparatus main body and arranging a scanner above the sheet discharger. However, such a configuration imposes limitation on the height of a space between the sheet discharger and the scanner, and thus only a limited number (capacity) of sheets are stackable on the sheet discharger.

When the thickness of each of the sheets used in image formation is uniform, the jam due to exceeding of the sheet discharge capacity can be easily prevented. For example, by detecting the volume of the stacked sheets with a sensor or the like, it is possible to avoid sheet discharge jam which may be caused by sheets discharged until the stacked sheets come into contact with the scanner.

However, there are image formation apparatuses which are capable of using objects with portions thicker than other portions such as envelopes as sheets. When such sheets with portions thicker than other portions are stacked, the thick portions stacked one on top of another sometimes come into contact with the scanner before the number of sheets discharged to the sheet discharger reaches the number of stackable sheets monitored by the sensor detection, and cause the sheet discharge jam. Besides envelopes, any sheet which has a portion thicker than the rest of the sheet may cause similar sheet discharge jam, and examples of such sheets are a sheet which has a portion provided with a bonding surface and a sheet to which a label is attached.

The disclosure is directed to a printing apparatus which can prevent sheet discharge jam also in printing of sheets each with thickness varying partly such as envelopes and which can reduce time and work required to release the jam.

A printing apparatus in accordance with some embodiments includes: a sheet discharge tray having an upstream portion in a discharge direction tilted to extend downward in a direction of gravity; an upper member arranged above the sheet discharge tray and limiting a height of a space above the sheet discharge tray; a printer configured to perform printing on sheets; a sheet discharger configured to discharge the sheets printed by the printer onto the sheet discharge tray; a full sensor arranged upstream of the sheet discharge tray in the discharge direction and configured to detect an upstream end of a top sheet of the sheets stacked on the sheet discharge tray; a counter configured to count a number of the sheets discharged onto the sheet discharge tray; and a controller configured to control the printer and the sheet discharger. The controller is configured to: determine whether to stop discharging of the sheets to the sheet discharge tray based on a detection result of the full sensor upon the sheets to be stacked on the sheet discharge tray including only sheets each with uniform thickness; and determine whether to stop discharging of the sheets to the sheet discharge tray based on a count value of the counter upon the sheets to be stacked on the sheet discharge tray including a sheet with thickness varying partly.

In the configuration described above, when the discharged sheets include only the sheets each with uniform thickness, the controller stops the printing by the printer under the condition that the full sensor detects a tray full state. Meanwhile, when the discharged sheets include the sheet with thickness varying partly, the controller stops the printing by the printer under the condition that the number of sheets discharged on the sheet discharge tray reaches the number of sheets which can be discharged and stacked on the sheet discharge tray.

Specifically, when the thickness of the discharged sheet varies partly, the sheet discharge tray is assumed to be full depending not on the detection output of the full sensor but on the number of sheets counted by the counter. As a result, it is possible to avoid sheet discharge jam in which the sheets stacked on the sheet discharge tray coming into contact with the upper member before the detection of the tray full state by the full sensor. Accordingly, it is possible to prevent the sheet discharge jam also in printing including a print operation of the sheet P with thickness varying partly and reduce time and work required to release the jam.

The printing apparatus may further include a sheet thickness sensor configured to detect thickness of each of the sheets. The controller may be configured to: determine whether the thickness of each of the sheets varies partly based on a detection result of the sheet thickness sensor; determine whether to stop the discharging to the sheet discharge tray based on the count value of the counter upon satisfaction of a condition where the sheet with thickness varying partly is stacked on the sheet discharge tray with an upstream portion of the sheet being thinner than the other portion of the sheet or with a downstream portion of the sheet being thicker than the other portion of the sheet; and determine whether to stop the discharging to the sheet discharge tray based on the detection result of the full sensor upon dissatisfaction of the condition.

In the configuration describe above, the controller can more surely determine whether each of the sheets is a sheet with thickness varying partly such as an envelope, based on the output of the sheet thickness sensor. Accordingly, sheets, including any of a sheet whose upstream portion when stacked is thinner than the other portion and a sheet whose downstream portion when stacked is thicker than the other portion, can be safely stacked up to the maximum number of stackable sheets.

DETAILED DESCRIPTION

Figure 1:
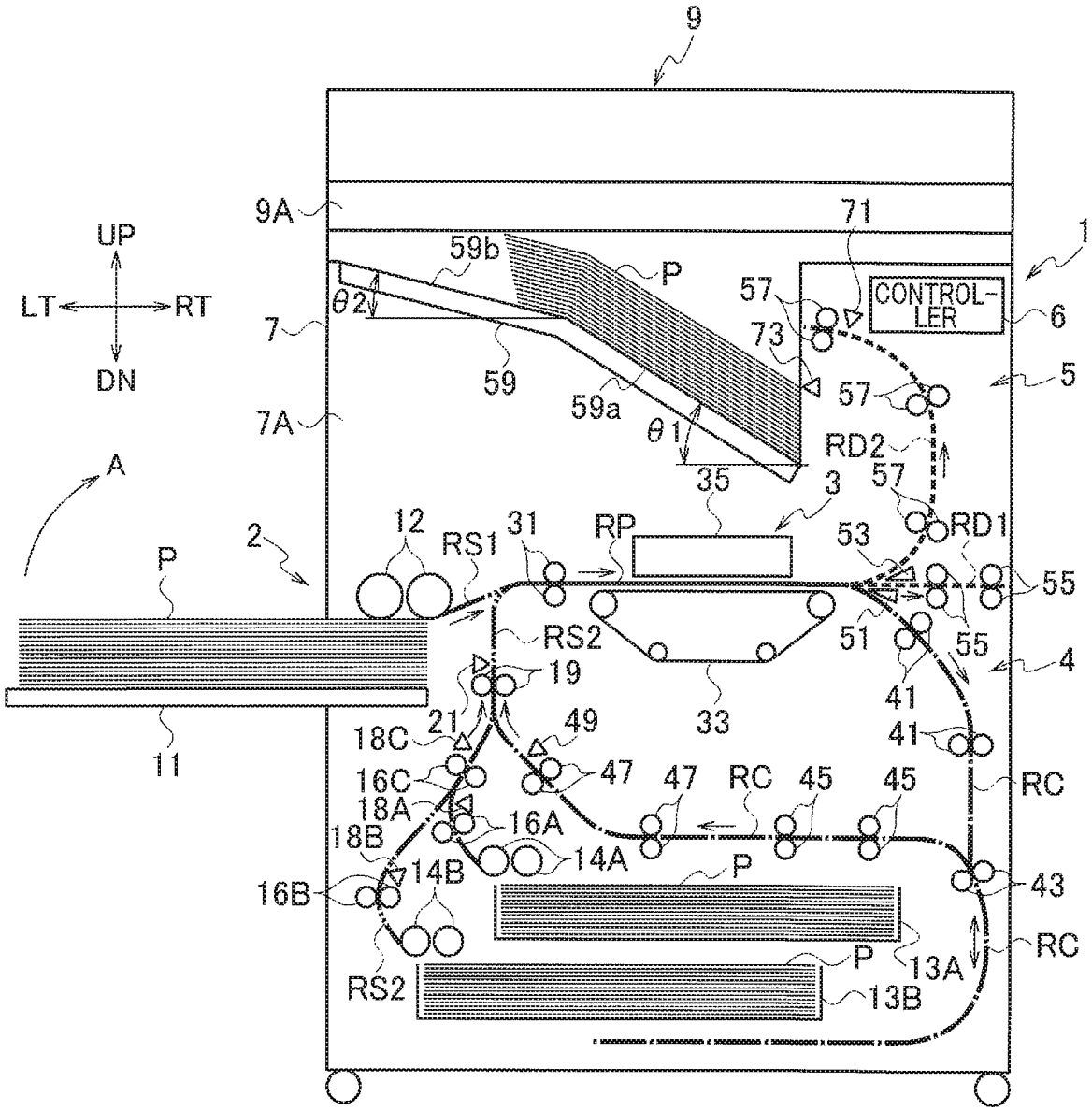
FIG. 1 is a schematic configuration diagram of a printing apparatus according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
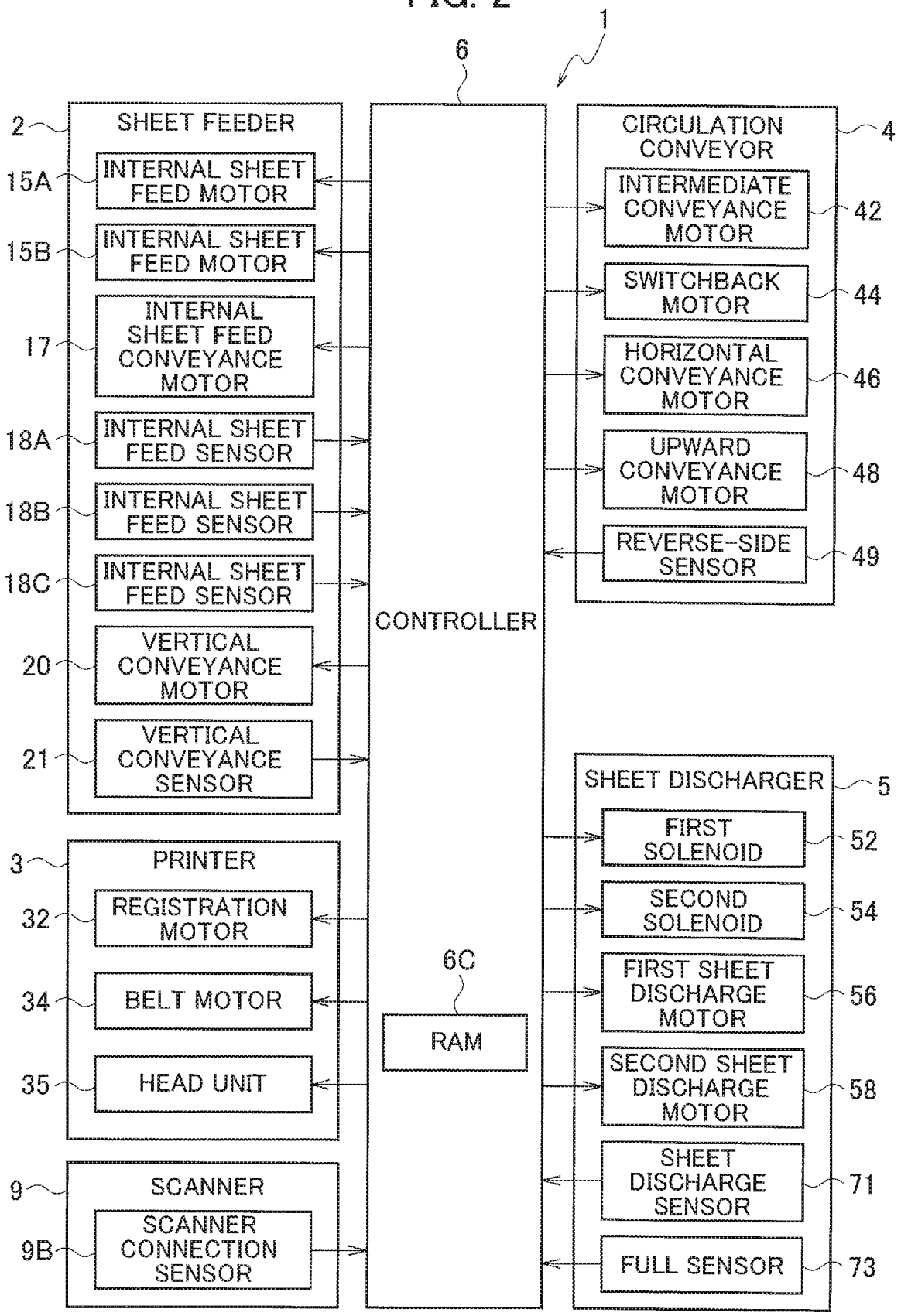
FIG. 2 is a control block diagram of the printing apparatus illustrated in FIG. 1.

FIG. 1 is a schematic configuration diagram of a printing apparatus 1 according to an embodiment of the present invention. FIG. 2 is a control block diagram of the printing apparatus 1 illustrated in FIG. 1. In the following description, a direction orthogonal to the sheet surface of FIG. 1 is referred to as a front-rear direction and a direction from the sheet surface toward a viewer is a front direction. Moreover, in FIG. 1, directions of right, left, up, and down are denoted by RT, LT, UP, and DN, respectively.

Note that, although an inkjet (IJ) printer is described herein as an example of the printing apparatus 1 capable of performing printing on sheets with thickness varying partly (i.e. sheets with ununiform or uneven thickness) such as envelopes, a facsimile apparatus, an image forming apparatus such as another type of printer or a photocopier, or the like may be employed as the printing apparatus 1.

In the printing apparatus 1 illustrated in FIG. 1, a conveyance route through which sheets P being print media are conveyed is illustrated by bold lines. In the conveyance route, a route illustrated by a solid line is a print route RP of a printer 3, a route illustrated by one-dot chain lines is a circulation route RC of a circulation conveyor 4, routes illustrated by broken lines are a first sheet discharge route RD1 and a second sheet discharge route RD2 of a sheet discharger 5, and routes illustrated by two-dot chain lines are an external sheet feed route RS1 and an internal sheet feed route RS2 of a sheet feeder 2. Upstream and downstream in the following description mean upstream and downstream in the conveyance route.

As illustrated in FIGS. 1 and 2, the printing apparatus 1 in the embodiment includes the sheet feeder 2, the printer 3, the circulation conveyor 4, the sheet discharger 5, a controller 6, a chassis 7 housing or holding these units, and a scanner (upper member) 9 arranged above an apparatus main body 7A covered with the chassis 7.

The sheet feeder 2 feeds unprinted sheets P to the printer 3. Moreover, the sheet feeder 2 refeeds the sheets P printed on front sides to the printer 3 in duplex printing. The sheet feeder 2 is arranged upstream of all the other units in the conveyance route. The sheet feeder 2 includes an external sheet feed tray 11, external sheet feed rollers 12, internal sheet feed trays 13A and 13B, internal sheet feed rollers 14A and 14B, internal sheet feed motors 15A and 15B, internal sheet feed conveyance rollers 16A to 16C, an internal sheet feed conveyance motor 17, internal sheet feed sensors 18A to 18C, vertical conveyance rollers 19, a vertical conveyance motor 20, and a vertical conveyance sensor 21.

The external sheet feed tray 11 is a tray on which the sheets P used for printing are stacked. Apart of the external sheet feed tray 11 is installed to be exposed to the outside of the chassis 7, and can be turned in a direction of an arrow A in FIG. 1 about a base end portion facing this part and housed in a left wall surface portion of the chassis 7 when no sheets are stacked thereon. For example, sheets P such as thick sheets and sheets with thickness varying partly such as envelopes can be stacked on the external sheet feed tray 11. Each of the sheets P with thickness varying partly such as envelopes is set on the external sheet feed tray 11 with a thin portion such as a flap portion of the envelope set as a trailing edge (upstream end) and with a thick portion formed by bonding such as an envelope bottom portion set as a leading edge (downstream side).

The external sheet feed rollers 12 pick up the sheets P stacked on the external sheet feed tray 11 one by one, and convey the sheets P along the external sheet feed route RS1 to registration rollers 31 of the printer 3.

The internal sheet feed trays 13A and 13B are trays on which the sheets P used for printing are stacked. The internal sheet feed trays 13A and 13B are arranged inside the chassis 7.

The pairs of internal sheet feed rollers 14A and 14B each pick up the sheets P stacked on a corresponding one of the internal sheet feed trays 13A and 13B one by one.

The internal sheet feed motors 15A and 15B rotationally drive the pairs of internal sheet feed rollers 14A and 14B, respectively.

The internal sheet feed conveyance rollers 16A and 16B convey the sheets P picked up from the internal sheet feed trays 13A and 13B by the internal sheet feed rollers 14A and 14B, to the internal sheet feed conveyance rollers 16C. The internal sheet feed conveyance rollers 16C convey each of the sheets P conveyed by the internal sheet feed conveyance rollers 16A or the internal sheet feed conveyance rollers 16B, to the vertical conveyance rollers 19. The internal sheet feed conveyance rollers 16C are arranged downstream of a point where a portion of the internal sheet feed route RS2 extending from the internal sheet feed rollers 14A and a portion of the internal sheet feed route RS2 extending from the internal sheet feed rollers 14B merge.

The internal sheet feed conveyance motor 17 rotationally drives the internal sheet feed conveyance rollers 16A to 16C.

The internal sheet feed sensors 18A to 18C detect the sheets P picked up from the internal sheet feed trays 13A and 13B and conveyed to the vertical conveyance rollers 19. The internal sheet feed sensors 18A to 18C are arranged at predetermined positions near and downstream of the pairs of internal sheet feed conveyance rollers 16A to 16C, respectively.

The vertical conveyance rollers 19 convey the sheets P conveyed from the internal sheet feed conveyance rollers 16C along the internal sheet feed route RS2, to the registration rollers 31 of the printer 3. Moreover, in the duplex printing, the vertical conveyance rollers 19 convey the sheets P printed on the front sides and conveyed and circulated along the circulation route RC, to the registration rollers 31. The vertical conveyance rollers 19 are arranged in the internal sheet feed route RS2, downstream of a point where the circulation route RC merges with the internal sheet feed route RS2.

The vertical conveyance motor 20 rotationally drives the vertical conveyance rollers 19. Moreover, the vertical conveyance motor 20 rotationally drives the external sheet feed rollers 12. The vertical conveyance motor 20 is connected to each of the pair of the vertical conveyance rollers 19 and the pair of the external sheet feed rollers 12 via a not-illustrated one-way clutch. Thus, the vertical conveyance rollers 19 are rotationally driven by rotation drive of the vertical conveyance motor 20 in one direction, whereas the external sheet feed rollers 12 are rotationally driven by rotation drive of the vertical conveyance motor 20 in the other direction.

The vertical conveyance sensor 21 detects the sheets P conveyed from the vertical conveyance rollers 19 to the registration rollers 31. The vertical conveyance sensor 21 is arranged at a predetermined position near and downstream of the vertical conveyance rollers 19.

The printer 3 prints images on the sheets P while conveying the sheets P. The printer 3 is arranged downstream of the sheet feeder 2. The printer 3 includes the registration rollers 31, a registration motor 32, a belt conveyer 33, a belt motor 34, and a head unit 35.

The registration rollers 31 temporarily stop each of the sheets P conveyed by the external sheet feed rollers 12 or the vertical conveyance rollers 19 to correct skew of the sheet P and then convey the sheet P to the belt conveyer 33. The registration rollers 31 are arranged in the print route RP in an upstream portion of the printer 3.

The registration motor 32 rotationally drives the registration rollers 31.

The belt conveyer 33 conveys the sheets P conveyed by the registration rollers 31 while sucking and holding the sheets P on a belt. The belt conveyer 33 is arranged downstream of the registration rollers 31.

The belt motor 34 drives the belt conveyer 33.

The head unit 35 has multiple line-type inkjet heads (not illustrated) in each of which multiple nozzles are aligned in a direction orthogonal to the conveyance direction of the sheets P (front-rear directions). The head unit 35 is arranged above the belt conveyer 33. The head unit 35 prints images by ejecting inks from the nozzles of the inkjet heads onto the sheets P conveyed by the belt conveyer 33.

The circulation conveyor 4 conveys the sheets P printed on the front sides along the circulation route RC and transfers the sheets P to the vertical conveyance rollers 19 in the duplex printing. The circulation conveyor 4 includes multiple pairs of intermediate conveyance rollers 41, an intermediate conveyance motor 42, switchback rollers 43, a switchback motor 44, multiple pairs of horizontal conveyance rollers 45, a horizontal conveyance motor 46, multiple pairs of upward conveyance rollers 47, and an upward conveyance motor 48, and a reverse-side sensor 49.

The intermediate conveyance rollers 41 convey the sheets P printed on the front sides, to the switchback rollers 43 in the duplex printing. The multiple pairs of intermediate conveyance rollers 41 are arranged along a portion of the circulation route RC between the printer 3 and the pair of switchback rollers 43.

The intermediate conveyance motor 42 rotationally drives the multiple pairs of intermediate conveyance rollers 41. Moreover, the intermediate conveyance motor 42 rotationally drives the most upstream pair of first sheet discharge rollers 55 and second sheet discharge rollers 57 except for the most downstream pair of the second sheet discharge rollers 57 to be described later.

The switchback rollers 43 switch back the sheets P conveyed by the intermediate conveyance rollers 41 and convey the sheets P to the horizontal conveyance rollers 45. The switchback rollers 43 are arranged downstream of the intermediate conveyance rollers 41, in the circulation route RC.

The switchback motor 44 rotationally drives the switchback rollers 43.

The horizontal conveyance rollers 45 convey the sheets P switched back by the switchback rollers 43, to the upward conveyance rollers 47. The multiple pairs of horizontal conveyance rollers 45 are arranged along an upstream portion of the circulation route RC between the pair of switchback rollers 43 and the point where the circulation route RC merges with the internal sheet feed route RS2.

The horizontal conveyance motor 46 rotationally drives the multiple pairs of horizontal conveyance rollers 45.

The upward conveyance rollers 47 convey the sheets P conveyed by the horizontal conveyance rollers 45, to the vertical conveyance rollers 19. The multiple pairs of upward conveyance rollers 47 are arranged along a downstream portion of the circulation route RC between the pair of switchback rollers 43 and the point where the circulation route RC merges with the internal sheet feed route RS2.

The upward conveyance motor 48 rotationally drives the multiple pairs of upward conveyance rollers 47.

The reverse-side sensor 49 detects the sheets P conveyed from the circulation conveyor 4 to the vertical conveyance rollers 19. The reverse-side sensor 49 is arranged at a predetermined position near and downstream of the most downstream pair of upward conveyance rollers 47.

The sheet discharger 5 discharges the printed sheets P. The sheet discharger 5 includes a first switching unit 51, a first solenoid 52, a second switching unit 53, a second solenoid 54, the multiple pairs of first sheet discharge rollers 55, a first sheet discharge motor 56, the multiple pairs of second sheet discharge rollers 57, a second sheet discharge motor 58, a sheet discharge tray 59, a sheet discharge sensor 71, and a full sensor 73.

The first switching unit 51 switches the conveyance route of the sheets P from the first sheet discharge route RD1 to the circulation route RC and vice versa. The first sheet discharge route RD1 is a route extending from a downstream end of the print route RP toward a post-processing device (not illustrated) arranged to the right of the apparatus main body 7A. The first switching unit 51 is arranged at a branching point between the first sheet discharge route RD1 and the circulation route RC.

The first solenoid 52 drives the first switching unit 51.

The first sheet discharge rollers 55 discharge the sheets P conveyed from the printer 3, to the post-processing device. The multiple pairs of first sheet discharge rollers 55 are arranged along the first sheet discharge route RD1.

The first sheet discharge motor 56 rotationally drives the first sheet discharge rollers 55 except for the most upstream pair of first sheet discharge rollers 55. The most upstream pair of first sheet discharge rollers 55 is rotationally driven by the intermediate conveyance motor 42.

The second switching unit 53 switches the conveyance route of the sheets P from the first sheet discharge route RD1 to the second sheet discharge route RD2 and vice versa. The second sheet discharge route RD2 is a route which branches from the first sheet discharge route RD1 at a position downstream of the branching point between the first sheet discharge route RD1 and the circulation route RC and extends to the sheet discharge tray 59. The second switching unit 53 is arranged at a branching point where the second sheet discharge route RD2 branches from the first sheet discharge route RD1.

The second solenoid 54 drives the second switching unit 53.

The second sheet discharge rollers 57 discharge the sheets P conveyed from the printer 3, to the sheet discharge tray 59. The multiple pairs of second sheet discharge rollers 57 are arranged along the second sheet discharge route RD2.

The second sheet discharge motor 58 rotationally drives the most downstream pair of second sheet discharge rollers 57. The second sheet discharge rollers 57 except for the most downstream pair of second sheet discharge rollers 57 are rotationally driven by the intermediate conveyance motor 42.

The sheet discharge tray 59 is a tray on which the sheets P discharged by the most downstream pair of second sheet discharge rollers 57 are stacked. The sheet discharge tray 59 is arranged at a downstream end of the second sheet discharge route RD2.

The sheet discharge tray 59 is arranged to be tilted in a direction from the upper left side toward the lower right side of the drawing such that a base end side of the sheet discharge tray 59 is located below the most downstream pair of the second sheet discharge rollers 57 in an upper surface portion of the apparatus main body 7A corresponding to the downstream end of the second sheet discharge route RD2.

The sheet discharge tray 59 has, for example, multiple tray surfaces 59*a* and 59*b* with different tilt angles to enable stacking of sheets P with a large size. An angle formed between the upstream tray surface 59*a* and the horizontal plane is referred to as $\theta 1$ and an angle formed between the downstream tray surface 59*b* and the horizontal plane is referred to as $\theta 2$. The angle $\theta 1$ of the upstream tray surface 59*a* is set to be greater than the angle $\theta 2$ of the downstream tray surface 59*b* ($\theta 1 > \theta 2$).

Moreover, the scanner 9 can be arranged above the apparatus main body 7A. When the scanner 9 is arranged as such, a space with a certain height is provided above the sheet discharge tray 59, between the sheet discharge tray 59 and a lower surface of a scanner stage 9A.

Specifically, the sheets P discharged by the most downstream pair of the second sheet discharge rollers 57 are stacked on the sheet discharge tray 59 in the aforementioned space in a stacked manner. Making the tilt angle ($\theta 1$) of the upstream tray surface 59*a* greater than the tilt angle ($\theta 2$) of the downstream tray surface 59*b* causes the sheets P to be stacked on the sheet discharge tray 59 with the trailing ends (upstream side) thereof aligned along a wall surface of the sheet discharger 5 in the stacking, and a sheet alignment characteristic of the sheet discharge tray 59 for the printed sheets P is thereby improved.

The sheet discharge sensor 71 detects the sheets P to be discharged onto the sheet discharge tray 59. The sheet discharge sensor 71 is arranged at a predetermined position near the most downstream pair of the second sheet discharge rollers 57.

The sheet discharge sensor 71 may be additionally provided with functions of, for example, a sheet thickness sensor which detects the thickness of the sheets P with respect to the conveyance direction depending a light transmission amount in sheet discharging and a sheet size determination sensor which determines the size of the sheet P with respect to the conveyance direction in sheet discharging. The sheet thickness sensor and the sheet size determination sensor can be arranged, for example, downstream or upstream of the printer 3 in the conveyance route, separately from the sheet discharge sensor 71.

The full sensor 73 detects a maximum stackable capacity (tray full state) of the sheets P discharged to and stacked on the sheet discharge tray 59. The full sensor 73 is arranged at a predetermined position on the wall surface of the sheet discharger 5 upstream of the sheet discharge tray 59, and detects a maximum height at which the sheets P does not come into contact with the scanner stage 9A, by detecting whether a trailing edge of a top surface of the sheets P stacked on the sheet discharge tray 59 reaches a sensor position.

As described above, since the sheets P are stacked with the trailing edges (upstream side) thereof aligned along the wall surface of the sheet discharger 5, the position of the trailing edge of the top surface of the printed sheets P can be detected by using only one full sensor 73, irrespective of the size of the sheets P stacked on the sheet discharge tray 59. Thus, the maximum stackable capacity can be surely detected in the case of stacking the sheets P of any size.

The full sensor 73 is preferably arranged at a highest possible position on the wall surface of the sheet discharger 5, in order that the maximum stackable capacity in the sheet discharge tray 59 can be set as large as possible.

Here, no serious trouble occurs when only the sheets P each with uniform (even) thickness are stacked. However, when the sheets P with thickness varying partly such as envelopes are mixed in the sheets P and, for example, are stacked on the sheet discharge tray 59 with thin portions such as flap portions of the envelopes being trailing edges (upstream end) and with thick portions formed by bonding such as envelope bottom portions being leading edges (downstream side), the leading edge portion of the sheet P comes into contact with the scanner stage 9A before the full sensor 73 configured to detect the trailing edge portion of the sheet P detects the tray full state, and sheet discharge jam may occur.

The scanner 9 is a scanning device which optically scans an image of an original and obtains information for printing in the printer 3 (detailed description is omitted), and can be arranged above the apparatus main body 7A by using the scanner stage 9A. The scanner 9 includes a scanner connection sensor 9B for detecting presence or absence of connection and outputting the detection result to the controller 6.

The controller 6 controls operations of the units in the printing apparatus 1. The controller 6 includes a CPU, a RAM (storage) 6C, a ROM, a hard disk drive, and the like.

The RAM (storage) 6C stores a sheet discharge counter which counts the number of discharged sheets according to an output of the sheet discharge sensor 71 and an envelope flag which is set (turned on) when the sheet P is the sheet with thickness varying partly such as an envelope. Moreover, the RAM (storage) 6C stores data on the number of sheets P stackable on the sheet discharge tray 59 causing no sheet discharge jam, for each sheet size.

In the case of performing the duplex printing, the controller 6 performs duplex printing of an interleaving method. The interleaving method is a method in which front sides of unprinted sheets P and back sides of sheets P printed on front sides are alternately subjected to printing while multiple sheets P are conveyed in the conveyance route.

In the duplex printing of the interleaving method, the controller 6 controls the sheet feeder 2 such that the feeding of the unprinted sheets P to the printer 3 and the refeeding of the sheets P printed on the front sides to the printer 3 are performed alternately.

In the case of performing the duplex printing by feeding the unprinted sheets P from the internal sheet feed tray 13A or 13B, the controller 6 performs control of switching an operation of the vertical conveyance rollers 19 of the sheet feeder 2 between a sheet feed conveyance operation and a sheet refeed conveyance operation. The controller 6 controls (determines) timings of the switching depending on a print schedule of the printer 3.

When the sheet P subjected to printing in the printer 3 is to be discharged to the post-processing device, the printed sheet P is guided to the first sheet discharge route RD1 by the first switching unit 51 and the second switching unit 53. Then, the sheet P is discharged to the post-processing device by the first sheet discharge rollers 55.

Meanwhile, when the printed sheet P is to be discharged to the sheet discharge tray 59, the printed sheet P is guided to the second sheet discharge route RD2 by the first switching unit 51 and the second switching unit 53. Then, the sheet P is discharged to the sheet discharge tray 59 by the second sheet discharge rollers 57.

Note that, when the sheet P subjected to the duplex printing is the sheet with thickness varying partly such as an envelope, for example, the sheet P may be circulated and conveyed along the circulation route RC again in the circulation conveyor 4 after the duplex printing and then discharged onto the sheet discharge tray 59 of the sheet discharger 5. The printed sheets P such as envelopes are thereby stacked (placed) on the sheet discharge tray 59 with the flap side being on the upstream side and the envelope bottom side on the downstream side.

As described above, the printing apparatus 1 according to the embodiment has the configuration in which the sheet discharger 5 is arranged in the upper surface portion of the apparatus main body 7A and the scanner 9 is arranged above the sheet discharger 5 and also has the configuration which includes the foldable external sheet feed tray 11 and the sheet feeder 2 provided in the chassis 7. Accordingly, it is possible to achieve downsizing and slimming down.

FIGS. 3A to 3D explain examples of the data on the number of sheets P stackable on the sheet discharge tray 59 which is stored in the RAM 6C for each sheet size PS.

Figure 3A:
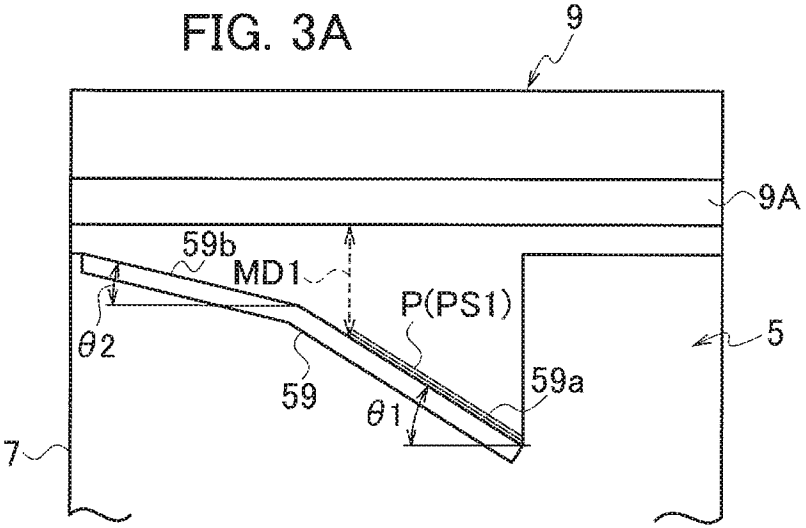
FIGS. 3A to 3D are explanatory views for explaining a relationship between a sheet size and the number of sheets stackable on a sheet discharge tray.

For example, as illustrated in FIG. 3A, when the size of the sheets P in the conveyance direction is shorter than the length of the tray surface 59*a* in the sheet conveyance direction as in the case of PS1, the number of sheets stackable on the sheet discharge tray 59 which does not exceed the sheet discharge capacity is set depending on the distance (height) MD1 from the position of the leading edges of the sheets P on the tray surface 59*a* to the scanner stage 9A.

Figure 3B:
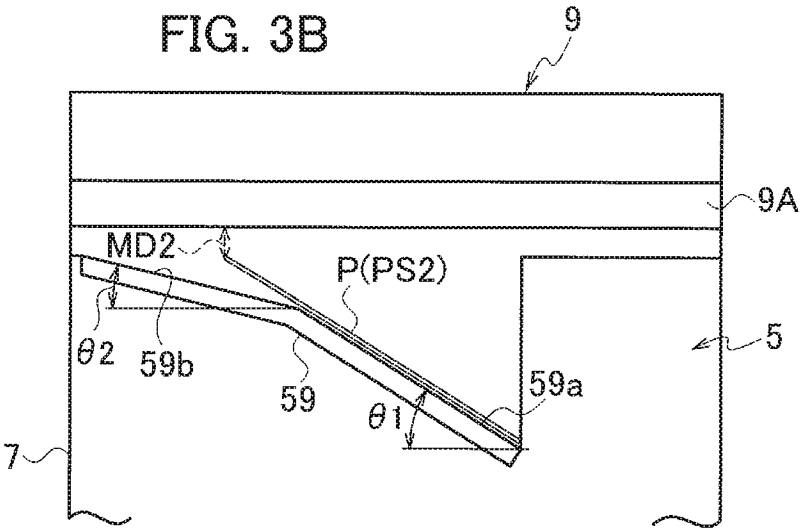
Figure 3C:
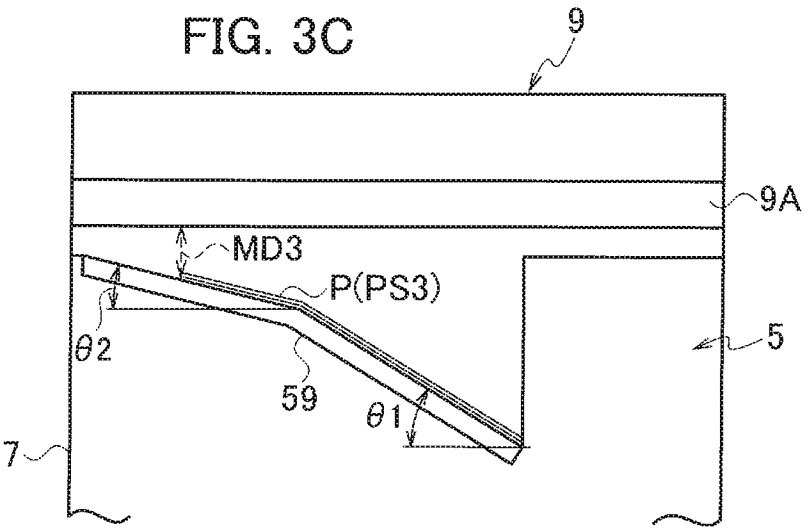

Meanwhile, as illustrated in FIG. 3C, when the size of the sheets P in the conveyance direction is far longer than the length of the tray surface 59*a* in the sheet conveyance direction as in the case of PS3, the sheets P are stacked with the leading edge portions thereof lying along the tray surface 59*b*. Accordingly, the number of sheets stackable on the sheet discharge tray 59 which does not exceed the sheet discharge capacity is set depending on the distance (height) MD3 from the position of the leading edges of the sheets P on the tray surface 59*b* to the scanner stage 9A.

Moreover, as illustrated in FIG. 3B, when the size of the sheets P in the conveyance direction is slightly longer than the length of the tray surface 59*a* in the sheet conveyance direction as in the case of PS2, the sheets P are stacked with the leading edge portions thereof lifted from the tray surface 59*b* by an amount depending on the stiffness (rigidity) thereof. Accordingly, the number of sheets stackable on the sheet discharge tray 59 which does not exceed the sheet discharge capacity is set depending on the distance (height) MD2 from the position of the leading edges of the sheets P on a plane obtained by extending the tray surface 59*a* in the conveyance direction to the scanner stage 9A.

Figure 3D:
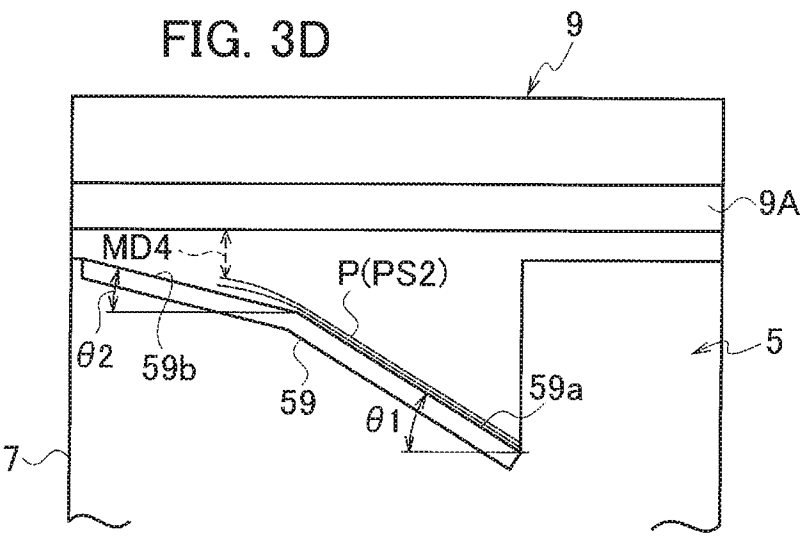

Furthermore, sheets with lower stiffness than the sheets P illustrated in FIG. 3B are also used. In the case of using the sheets with low stiffness, the sheets P are not stacked with the leading edge portions thereof lying along the tray surface 59*b* like the sheets P illustrated in FIG. 3C or stretching along the extended plane of the tray surface 59*a* like the sheets P illustrated in FIG. 3B, and instead are stacked with the leading edge portions thereof sagging as illustrated in FIG. 3D.

In this case, the number of sheets stackable on the sheet discharge tray 59 which does not exceed the sheet discharge capacity is set depending on the distance (height) MD4 from the position of the leading edge of the top sheet P on the tray surface 59*b* to the scanner stage 9A.

Note that the data on the number of sheets stackable on the sheet discharge tray 59 may be set in advance for each sheet size PS depending on sheet feed setting and the like or may be settable and changeable by a user or a service personnel performing maintenance.

Next, description is given of control in sheet discharge by the controller 6 in the printing apparatus 1 according to the embodiment.

Figure 4:
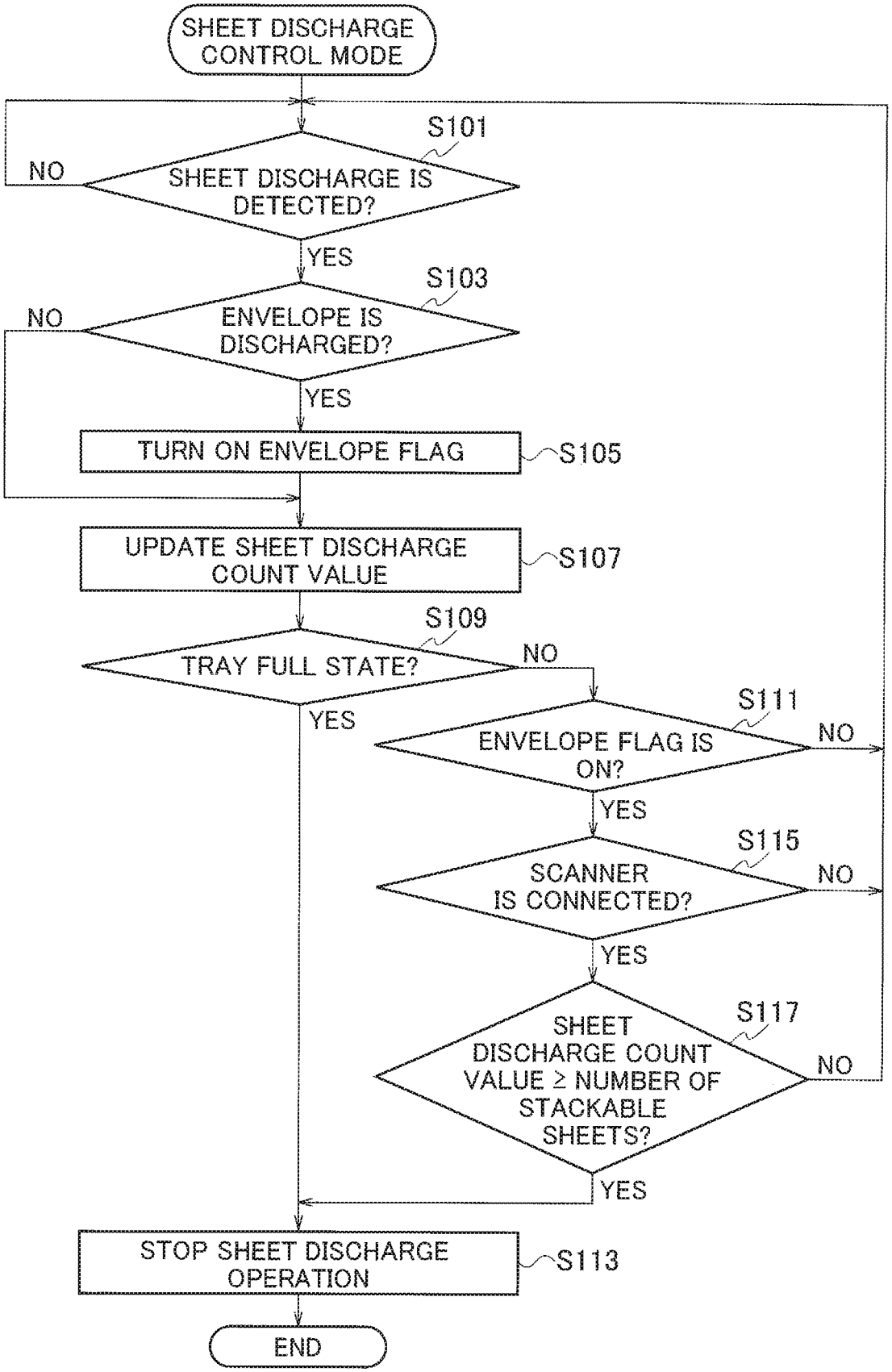
FIG. 4 is a flowchart for explaining control relating to a sheet discharge operation.

FIG. 4 is a flowchart for explaining a flow of processing relating to the sheet discharge operation. Here, description is given of an example in which the sheet discharge sensor 71 is additionally provided with the functions of the sheet thickness sensor and the sheet size determination sensor and the controller 6 detects the sheet size PS and whether the discharged sheet P is an envelope or not, in addition to presence or absence of the sheet discharge, based on output of the sheet discharge sensor 71.

During the execution of the print operation, the controller 6 determines whether the printed sheet P is discharged onto the sheet discharge tray 59 in the sheet discharger 5, by checking the output of the sheet discharge sensor 71 (step S101).

When the sheet discharge is not detected (step S101; NO), the controller 6 waits at step S101 until the sheet discharge is detected.

When the sheet discharge is detected (step S101; YES), the controller 6 determines whether the discharged sheet P is an envelope or not, from the output of the sheet discharge sensor 71 (step S103). In this determination, for example, when the discharged sheet P is an envelope, the controller 6 may also determine whether the sheet P is stacked with the flap portion thereof being on the upstream side or the downstream side of the sheet discharge tray 59.

When the discharged sheet P is not an envelope (step S103; NO), the controller 6 causes the processing to proceed to step S107.

When the discharged sheet P is an envelope (step S103; YES), the controller 6 turns on the envelope flag stored in the RAM 6C (step S105) and increments the count value of the sheet discharge counter.

Next, the controller 6 determines whether the sheet discharge tray 59 has become full due to the discharged sheet P, from the output of the full sensor 73 (step S109).

When the controller 6 determines that the sheet discharge tray 59 is full (step S109; YES), the controller 6 controls the sheet feeder 2, the printer 3, the circulation conveyor 4, and the like to immediately halt the print operation and stop the sheet discharge operation (step S113).

When the controller 6 determines that the sheet discharge tray 59 is full in the middle of the print operation as described above, the controller 6 determines that the sheet discharge tray 59 is already full (has reached the maximum stackable capacity) irrespective of presence or absence of the sheet P with thickness varying partly such as an envelope, and controls the sheet feeder 2, the printer 3, the circulation conveyor 4, and the like to immediately stop the sheet discharge operation.

The controller 6 notifies the user of the tray full state by using a liquid crystal panel of a not-illustrated operation unit or the like and thereby prompts the user to resolve the tray full state, that is to collect the printed sheets P on the sheet discharge tray 59.

Then, after the tray full state is resolved, the controller 6 clears the count value of the sheet discharge counter and the envelope flag and resumes the print operation, for example, when the user operates (performs re-input on) a start button (not illustrated) of the operation unit.

Meanwhile, when the controller 6 determines that the sheet discharge tray 59 is not to be full (step S109; NO), the controller 6 causes the processing to proceed to step S111. Specifically, in step S111, the controller 6 determines whether the envelope flag is on.

When the envelope flag is not on (step S111; NO), the controller 6 causes the processing to proceed to step S101.

Specifically, when the controller 6 determines from the envelope flag that no sheet P with thickness varying partly such as an envelope is discharged during the print operation, the controller 6 continues the series of aforementioned operations associated with the print operation until the print operation for the specified number of sheets is completed as normal processing for sheets P with uniform thickness or until the full sensor 73 detects the tray full state in the sheet discharger 5.

Meanwhile, when the controller 6 determines that the envelope flag is on (step S111; YES), the controller 6 determines whether the scanner 9 is connected based on output of the scanner connection sensor 9B (step S115).

When the controller 6 determines that the scanner 9 is connected (step S115; YES), the controller 6 reads the data on the number of stackable sheets depending on the sheet size PS from the RAM 6C based on the output of the sheet discharge sensor 71 and compares the number with the count value of the sheet discharge counter (step S117).

When the number of discharged sheets is determined to have reached the number of stackable sheets specified in advance (step S117; YES), the controller 6 causes the processing to proceed to step S113 and controls the sheet feeder 2, the printer 3, the circulation conveyor 4, and the like to immediately halt the print operation and stop the sheet discharge operation.

When the controller 6 determines from the envelope flag that the sheet P with thickness varying partly such as an envelope is discharged during the print operation, the controller 6 compares the count value of the sheet discharge counter and the data on the number of stackable sheets stored in the RAM 6C depending on whether the scanner 9 is connected or not, and when determining that the number of sheets P on the sheet discharge tray 59 has reached the number of stackable sheets with the scanner 9 being connected, immediately stops the sheet discharge operation and notifies the user.

Note that, when the scanner 9 is not connected (step S115; NO), the controller 6 cause the processing to proceed to step S101.

Specifically, when the connection of the scanner 9 cannot be confirmed, no jam due to exceeding of the sheet discharge capacity occurs. Accordingly, the controller 6 continues the series of aforementioned operations associated with the print operation until the printing operation for the specified number of sheets is completed or until the full sensor 73 detects the tray full state.

Similarly, when the number of discharged sheets is determined not to have reached the number of stackable sheets (step S117; NO), the controller 6 causes the processing to proceed to step S101 and continues the series of aforementioned operations associated with the print operation until the printing operation for the specified number of sheets is completed, until the full sensor 73 detects tray full state, or until the number of sheets P on the sheet discharge tray 59 reaches the number of stackable sheets.

As described above, the printing apparatus 1 according to the embodiment can determine the tray full state of the sheets P in the sheet discharger 5 while switching the method of the determination between the determination based on the detection output of the full sensor 73 and the determination based on the number of sheets P actually discharged onto the sheet discharge tray 59 without using the detection output of the full sensor 73, depending on whether the sheet P with thickness varying partly such as an envelope is discharged onto the sheet discharge tray 59.

Specifically, the printing apparatus 1 according to the embodiment utilizes the detection result from the full sensor 73 when the thickness is uniform in the sheets P stacked on the sheet discharge tray 59, and utilizes the detection result from the sheet discharge sensor 71 when the thickness varies partly in any of the sheets P stacked on the sheet discharge tray 59. As a result, it is possible to avoid the sheet discharge jam caused by the sheet P with thickness varying partly such as an envelope in which the sheets P stacked on the sheet discharge tray 59 come into contact with the scanner stage 9A before the full sensor 73 detects the tray full state. Hence, the printing apparatus 1 can prevent the sheet discharge jam also when printing includes printing of the sheet P with thickness varying partly such as an envelope and reduce time and work required to release the jam. Moreover, preventing the sheet discharge jam can reduce the sheets P wasted by the jam.

In the embodiment described above, the thickness of the sheets P is substantially proportional to the sheet size PS and the number of stackable sheets P on the sheet discharge tray 59 is therefore stored for each of the sheet sizes PS. However, the present invention is not limited to this configuration and the number of stackable sheets P may be stored for, for example, each of the thicknesses, paper qualities, and the like of the sheets P.

Moreover, the sheet P with thickness varying partly is not limited to an envelope and may be, for example, a sheet which has a portion provided with a bonding surface, a sheet to which a label is attached, or the like.

Moreover, the upper member is not limited to the scanner 9 and may be any member which limits the height of the space above the sheet discharge tray 59.

Moreover, the printing apparatus 1 is not limited to have the configuration in which the sheet discharge tray 59 is arranged in an upper portion of the apparatus main body 7A and the scanner 9 is arranged above the sheet discharge tray 59. For example, the sheet discharge tray 59 may be arranged in a middle or lower portion of the apparatus main body 7A or the upper member may be formed of members other than the scanner 9.

Furthermore, the controller 6 may determine the tray full state from the number of sheets P actually discharged onto the sheet discharge tray 59 as described above when the number of discharged sheets P with thickness varying partly such as envelopes reaches or exceeds a predetermined number.

Moreover, since the full sensor 73 detects the position of the trailing edge of the top surface of the sheets P stacked on the sheet discharge tray 59, the leading edge of the top surface of the sheets P stacked on the sheet discharge tray 59 and having thickness varying partly may reach the scanner stage 9*a* and come into contact therewith before the full sensor 73 detects the tray full state, thereby causing the sheet discharge jam. The following control may be performed to counter this problem. Specifically, the controller 6 determines whether the thickness of each sheet P varies partly based on the detection result of the sheet discharge sensor 71 (sheet thickness sensor). When the sheet P with thickness varying partly is stacked on the sheet discharge tray 59 with the upstream portion of the sheet P being thinner than the other portion (for example, with a thin portion such as a flap portion of an envelope located on the upstream side) or with the downstream portion of the sheet P being thicker than the other portion (for example, with a thick portion formed by bonding such as an envelope bottom portion of an envelope located on the downstream side), the controller 6 determines whether to stop the sheet discharging to the sheet discharge tray 59 based on the count value of the sheet discharge counter. In cases other than those described above, the controller 6 determines whether to stop the sheet discharging to the sheet discharge tray 59 based on the detection result of the full sensor 73. In such a configuration, the sheets P, including any of a sheet whose upstream portion when stacked is thinner than the other portion and a sheet whose downstream portion when stacked is thicker than the other portion, can be safely stacked up to the maximum number of stackable sheets.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing apparatus comprising:

a sheet discharge tray having an upstream portion in a discharge direction tilted to extend downward in a direction of gravity;

an upper member arranged above the sheet discharge tray and limiting a height of a space above the sheet discharge tray;

a printer configured to perform printing on sheets;

a sheet discharger configured to discharge the sheets printed by the printer onto the sheet discharge tray;

a full sensor arranged upstream of the sheet discharge tray in the discharge direction and configured to detect an upstream end of a top sheet of the sheets stacked on the sheet discharge tray;

a counter configured to count a number of the sheets discharged onto the sheet discharge tray; and a controller configured to control the printer and the sheet discharger, wherein the controller is configured to:

determine whether to stop discharging of the sheets to the sheet discharge tray based on a detection result of the full sensor upon determining based on a user input of sheet data or a detection result of a sheet thickness sensor that the sheets to be stacked on the sheet discharge tray include only first sheets each with uniform thickness; and determine whether to stop discharging of the sheets to the sheet discharge tray based on a count value of the counter upon determining based on the user input of sheet data or the detection result of the sheet thickness sensor that the sheets to be stacked on the sheet discharge tray include a second sheet having a first portion and a second portion, the first portion having a thickness lesser than a thickness of the second portion.

2. The printing apparatus according to claim 1, wherein the sheet thickness sensor is configured to detect thickness of each of the sheets, and wherein the controller is configured to:

determine whether the thickness of each of the sheets varies partly based on a detection result of the sheet thickness sensor;

determine whether to stop the discharging to the sheet discharge tray based on the count value of the counter upon satisfaction of a condition where the second sheet is stacked on the sheet discharge tray with an upstream portion of the sheet being thinner than the other portion of the sheet or with a downstream portion of the sheet being thicker than the other portion of the sheet; and determine whether to stop the discharging to the sheet discharge tray based on the detection result of the full sensor upon dissatisfaction of the condition.

3. The printing apparatus according to claim 1, wherein the second sheet is at least one of the following:

an envelope with a flap as the first portion;

a sheet with a bonding surface as the first portion; or a sheet with a label as the first portion.

4. The printing apparatus according to claim 1, wherein the upper member is a scanner.

* * * * *